US005272507A

United States Patent [19]

Yoshida et al.

[11] Patent Number: 5,272,507

[45] Date of Patent: Dec. 21, 1993

[54] CHARGING DEVICE FOR ELECTROPHOTOGRAPHIC EQUIPMENT

[75] Inventors: Mayumi Yoshida; Yusuke Shimbo, both of Tokyo, Japan

[73] Assignee: Rioch Company, Ltd., Tokyo, Japan

[21] Appl. No.: 834,197

[22] Filed: Feb. 12, 1992

[30] Foreign Application Priority Data

Feb. 14, 1991 [JP] Japan ..... 3-012701[U]
Jun. 14, 1991 [JP] Japan ..... 3-170556
Jan. 31, 1992 [JP] Japan ..... 4-046047

[51] Int. Cl.[5] ..... G03G 15/02
[52] U.S. Cl. ..... 355/225; 361/235
[58] Field of Search ..... 355/219, 221, 225, 223; 361/225, 235

[56] References Cited

U.S. PATENT DOCUMENTS 4,920,380 4/1990 Ueda et al. ..... 355/225 X
4,954,843 9/1990 Oka et al. ..... 355/225 X
5,060,017 10/1991 Ueda ..... 355/221

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

A scorotron charging device applicable to electrophotographic image forming equipment and having a main charger with discharge wires and a grid and applying voltages to the wires and the grid by respective power sources. The two power sources are controlled by the same control signal. In response to the control signal, a voltage starts being applied to the grid before a voltage is applied to said wires and ends being applied to the grid after the voltage application to the wires has ended. This allows the charge potential of a photoconductive element to rise and fall rapidly.

4 Claims, 6 Drawing Sheets

CHARGING DEVICE FOR ELECTROPHOTOGRAPHIC EQUIPMENT

BACKGROUND OF THE INVENTION

The present invention relates to a charging device for electrophotographic image forming equipment and, more particularly, to a scorotron charging device having a main charger with discharge wires and a grid and applying voltages to the wires and the grid by respective power sources.

It is a common practice with electrophotographic image forming equipment, e.g., a copier, facsimile transceiver or laser printer to charge, before imagewise exposure, the surface or a photoconductive element or image carrier by a charging device which effects corona discharge. For the corona discharge, a voltage is applied to a discharge wire forming part of a main charger which is included in the discharging device. When the products of discharge, toner particles or similar impurities deposit on the discharge wires, the corona discharge and, therefore, the charge distribution on the surface of the photoconductive element becomes irregular. This prevents a toner from depositing in a constant amount on a latent image electrostatically formed on the photoconductive element in the event of development. A scorotron charging device is an effective implementation against such an occurrence and has a grid between the discharge wire and the photoconductive element. Specifically, a scorotron charger generally has a main charger made up of one or more discharge wires and a casing connected to ground, a grid interposed between the wires and the photoconductive element, a common power source for applying voltages to both of the wires and grid, a switch connected between the wires and grid and the common power source, a controller for controlling the switch, and a varistor intervening between the switch and the grid. When the controller closes the switch, part of the charge generated by the wires is released to ground via the casing while the other part is directed toward the grid and photoconductive element. Since a voltage controlled by the varistor is applied to the grid, the amount of charge to be deposited on the surface of the photoconductive element is also controlled. This type of scorotron charger is disclosed in, for example, Japanese Patent Laid-Open Publication No. 72177/1989.

The conventional scorotron charger in which the discharge wires and grid share a single power source has a problem that a substantial period of time is necessary for the grid voltage to rise or fall. Assuming that the timing for starting charging the photoconductive element is delayed, then a bias voltage for development will rise first and cause a toner to deposit on the surface of the element other than an image area. This not only results in the waste of toner but also increases the load on a cleaning device for cleaning the photoconductive element. On the other hand, assuming that the wire voltage rises before the grid voltage, then the photoconductive element will be charged excessively to suffer from fast fatigue or to cause a toner or a carrier to deposit needlessly on the element. Further, since the power source for applying a voltage to the grid has a high impedance, it is likely that a current fails to flow from the wires to the grid and leaks from the wires to the photoconductive element to thereby burn the element 601.

SUMMARY OF THE INVENTION

It is, therefore, an object of the present invention to provide a charging device for image forming equipment which eliminates the excessive charging of a photoconductive element and the burning of the element due to a leak which are ascribable to the time when the grid voltage starts rising or falling and the period of time necessary for the grid voltage to fully rise or fully fall.

It is another object of the present invention to provide a charging device for image forming equipment which eliminates the deposition of needless toner or carrier on a photoconductive element by speeding up the rise or fall of the potential of the element or by starting and ending the application of a bias voltage for development in matching relation to the time when the charged area of the element passes a developing position.

In accordance with the present invention, a scorotron charging device for electrophotographic image forming equipment comprises a main charger for discharging, a grid located in close proximity to the main charger, a main power source for applying a voltage to the main charger, a grid power source for applying a voltage to the grid, and a controller for controlling a timing for the main charger power source to apply a voltage and a timing for the grid power source to apply a voltage.

Also, in accordance with the present invention, a scorotron charging device for electrophotographic image forming equipment comprises a main charger for discharging, a grid located in close proximity to the main charger, a controller for generating a trigger signal for commanding the start of application of voltages to the main charger and grid, a main charger applying section for applying a voltage to the main charger at a predetermined timing in response to the trigger signal, and a grid applying section for applying a voltage to the grid at a predetermined timing in response to the trigger signal.

To better understand the present invention, a brief reference will be made to a conventional scorotron charging device, shown in FIG. 6. As shown, the charging device, generally 602, negatively charges a photoconductive element in the form of a drum 601 and has a main charger made up of wires 602*a* and a casing 602*b* which is connected to ground, a grid 602*c*, a power source 603 for applying voltages to the wires 602*a* and grid 602*c*, and a varistor 604 connected between the grid 602*c* and a switch SO. A controller 605 selectively turns on or off the switch SO for controlling the timing at which the power source should apply a voltage. The discharge wires 602*a* and grid 602*c* share the single power source 603. When the controller 605 turns on the switch SO, part of the charge (negative) generated by the wires 602*a* is released to ground via the casing 602*b* while the other part is directed toward the grid 602*c* and the drum 60. Further, a voltage controlled by the varistor 604 is applied to the grid 602*c* so as to control the amount of charge to be deposited on the drum 601.

The conventional charging device has various problems due to the fact that the wires 602*a* and grid 602*c* share a single power source, as discussed earlier. Specifically, a substantial period of time is necessary for the grid voltage to rise or fall. Assuming that the timing for starting charging the drum 601 is delayed, then a bias voltage for development will rise first and cause toner to deposit on the surface of the drum 601 at other than an image area. This not only results in the waste of toner but also increases the load on a cleaning device for cleaning the drum 601. Assuming that the wire voltage rises before the grid voltage, then the drum 601 will be charged excessively to suffer from fast fatigue or to cause a toner or a carrier to deposit needlessly on the element 601. Further, since the power source 603 for applying a voltage to the grid 602*c* has a high impedance, it is likely that a current fails to flow from the wires 602*a* to the grid 602*c* and leaks from the wires 602*a* to the drum 601 to thereby burn the drum 601.

FIGS. 7A and 7B each show a relation of the voltages applied to the wires 602*a* and grid 602*c* and the charge potential of the drum 601 to one another. In FIGS. 7A and 7B, horizontal dash-and-dot lines associated with the wire voltages are representative of a discharge start voltage while horizontal dash-and-dot lines associated with the drum potentials are representative of a target charge potential. Regarding time, the time $t_0$ when the wire voltage starts rising is used as a reference.

The relation shown in FIG. 7A holds when the voltage of the grid 602*c* starts rising later than the voltage of the wires 602*a*. In this condition, the wire voltage reaches the discharge start voltage at a time $t_1$, i.e., on the elapse of a period of time $T_1$ as counted from the time $t_0$ and fully rises at a time $t_2$ which is a period of time Tc later than the time $t_0$. On the other hand, the grid voltage starts rising at a time $t_3$ which is a period of time $T_2$ later than the time $t_0$ and fully rises on the elapse of a period of time Tg, i.e., at a time $t_4$. Since the wire voltage does not reach the discharge start voltage up to the time $t_1$, the charge having been accumulated on the drum 601 up to the time $t_1$ is extremely small. During the interval between the times $t_1$ and $t_3$, the grid voltage does not rise despite the rise of the wire voltage to the discharge start voltage. This, coupled with the fact that the impedance between the grid 602*c* and ground is high and prevents a current from easily flowing from the wires 602*a* to the grid 602*c*, charges the drum 601 excessively far beyond the target charge potential. Then, a current is apt to leak from the wires 602*a* to the drum 601. As the grid voltage starts rising at the time $t_3$, the charge potential once noticeably falls and then sequentially rises with the rise of the grid voltage. When a period of time Td from the time $t_0$ at which the wire voltage starts rising to the time $t_4$ at which the grid voltage fully rises expires, the target charge potential is set up stably.

The relation shown in FIG. 7B holds when the wire voltage and grid voltage start rising at the same time and the period of time Tg necessary for the grid voltage to fully rise is longer than the period of time Tc necessary for the wire voltage to do so. As shown, during the period of time $T_1$ in which the wire voltage reaches the discharge start voltage, only a small amount of charge is accumulated on the drum 601, as in the relation of FIG. 7A. Thereafter, although the wire voltage fully rises at the time $t_2$, i.e., on the elapse of the period of time Tc, the charge potential of the drum 601 sequentially rises from the time $t_1$ to the time $t_4$ since the grid voltage fully rises at the time $t_4$, i.e., on the elapse of the period of time Tg which is longer than Tc. During this period, the timing for starting charging of the drum 601 is delayed, i.e., the bias voltage for development rises first. Then, it is likely that a toner deposits on the surface of the drum 601 other than an image area, and that a toner or a carrier deposits on the image area on the drum 601 with no regard to the direction of the bias voltage.

BRIEF DESCRIPTION OF THE DRAWINGS

The above and other objects, features and advantages of the present invention will become more apparent from the following detailed description taken with the accompanying drawings in which:

Referring to FIG. 1, a copier or similar image forming equipment of the type using a two-component developer is shown to which a scorotron charging device embodying the present invention is applied. As shown, a scorotron charging device, generally 102, negatively charges the surface of a photoconductive element or drum 101. A developing device 103 develops a latent image electrostatically formed on the charged surface of the drum 101 by exposure by using a toner. An image density sensor 104 senses the density of reference toner images formed on the drum 101 in a predetermined pattern. A transfer charger 106 transfers the toner image formed on the drum 101 to a recording sheet 105 being transported. A separation charger 107 separates the recording sheet 105 from the drum 101 after the image transfer. A separator in the form of a pawl 108 insures the separation of the recording sheet 105 from the drum 101. A cleaning device 109 removes the toner remaining on the drum 101 after the image transfer. A discharge lamp 110 dissipates the charge remaining on the drum 101 after the drum 101 has been cleaned by the cleaning device 109. The developing device 103 has a toner hopper 111 storing fresh toner, not shown, a toner supply roller 112 for discharging the toner from the hopper 111, a developing sleeve 115 for conveying the toner to the drum 101, a paddle 113 for agitating the developer, i.e., a mixture of toner and carrier to charge the toner by friction and conveying the developer to the developing sleeve 115, and a doctor blade 114 for regulating the amount of developer deposited on the developing sleeve 15. It is to be noted that a bias voltage for development is applied to the developing sleeve 115 for adjusting the amount of toner to deposit on the drum 101. In the figure, labeled Tb is the period of time necessary for the charged surface of the drum 101 to move from the charging device 102 to the developing sleeve 115.

Figure 1:
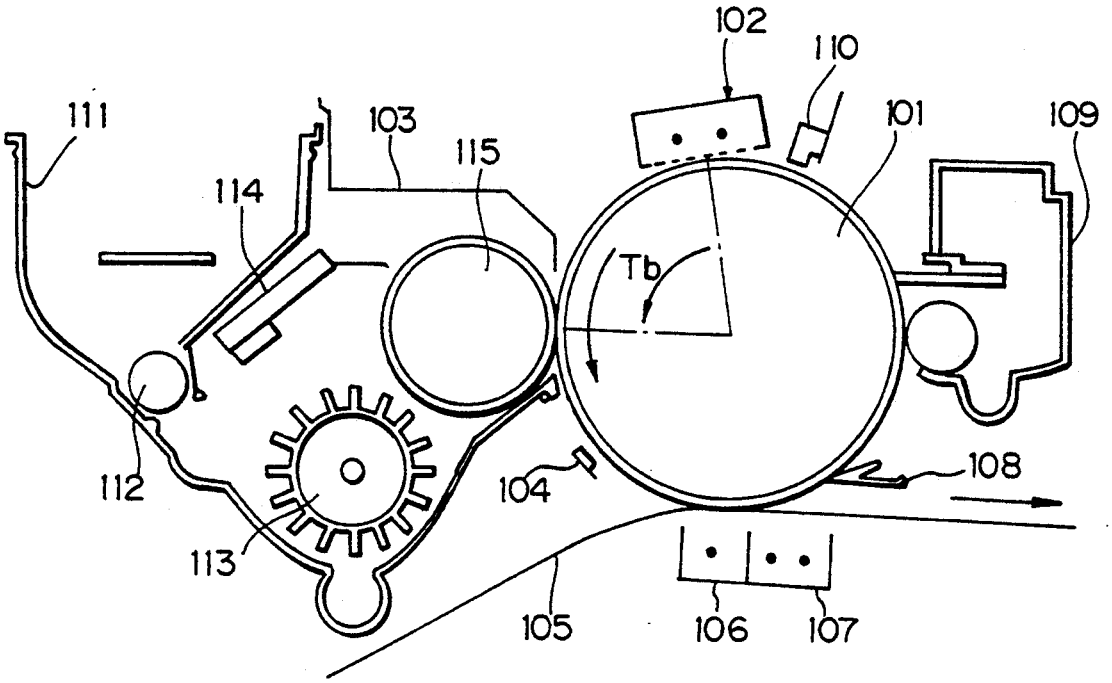
FIG. 1 is a section of image forming equipment to which a scorotron charger embodying the present invention is applied.

In operation, while the drum 101 is rotated in a direction indicated by an arrow in the figure, the charging device 102 charges the surface of the drum 101 to a negative polarity by corona discharge. As the charged surface of the drum 101 is exposed imagewise, the charge is dissipated in matching relation to the intensity of light with the result that a latent image is electrostatically formed. The developing device 103 develops the latent image by the toner to convert it to a corresponding toner image. As the recording sheet 105 is transported at a predetermined timing, the toner image is transferred from the drum 101 to the sheet 105 by the transfer charger 106. The recording sheet 105 carrying the toner image thereon is separated from the drum 101 by the separation charger 107. The cleaning device 109 removes the toner remaining on the drum 101 after the image transfer, and then the discharge lamp 110 dissipates the charge remaining on the drum 101 by light.

Figure 2:
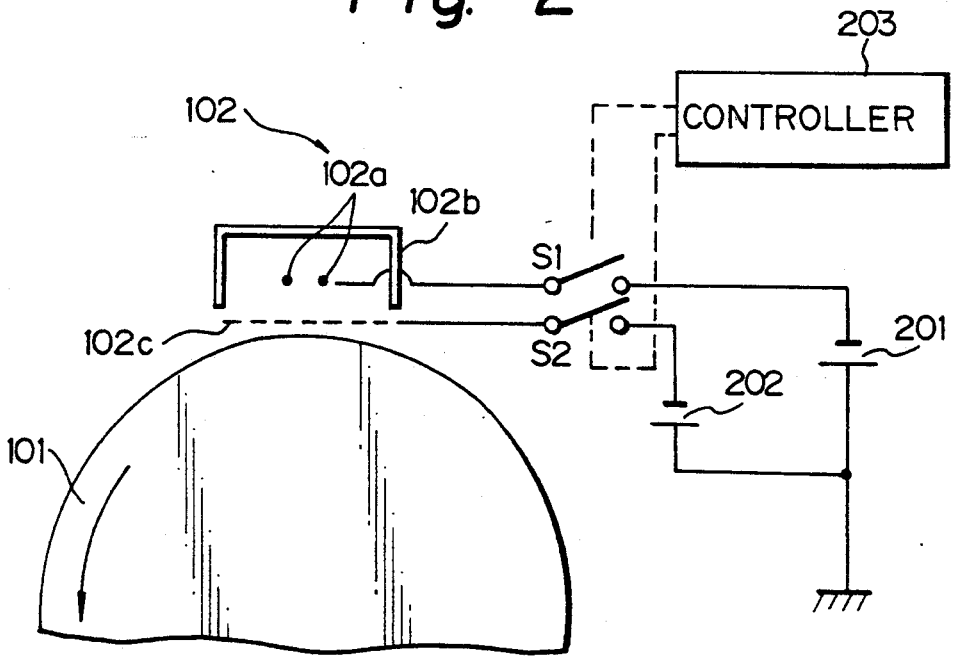
FIG. 2 shows the construction of the charging device of FIG. 1.
Figure 3:
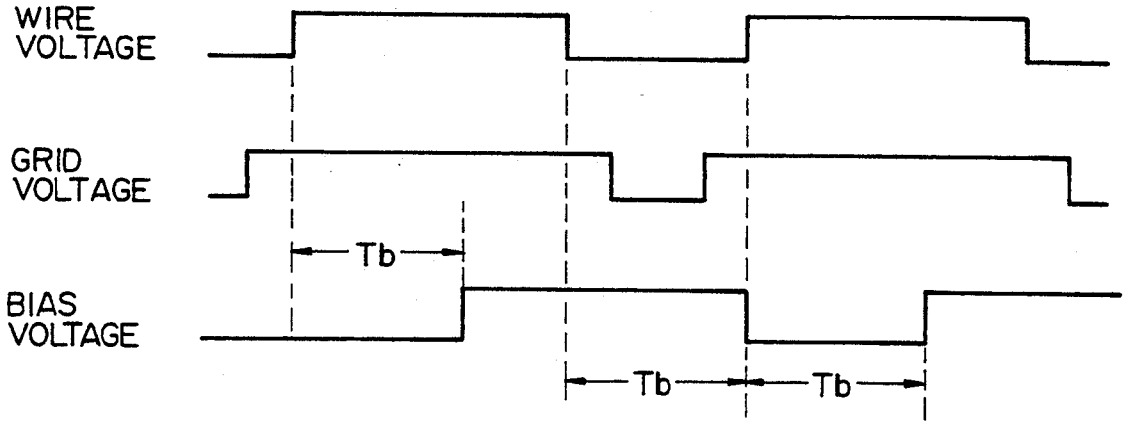
FIG. 3 is a timing chart indicating timings for applying voltages to discharge wires and a grid included in the charging device of FIG. 2.

FIG. 2 shows the scorotron charging device 102 embodying the present invention. As shown, the charging device 102 has a main charger made up of discharge wires 102*a* and a casing 102*b* connected to ground, a grid 102*c*, a main power source 201 for applying a voltage to the wires 102*a*, a grid power source 202 for applying a voltage to the grid 102*c*, a switch S1 connected between the wires 102*a* and the main power source 201, and a switch S2 connected between the grid 102*c* and the grid power source 202. A controller 203 selectively turns on or off the switches S1 and S2 at predetermined timings. In this manner, the wires 102*a* and the grid 102*c* are provided with respective power sources. For this reason, the conventional varistor does not exist between the grid 102*c* and the grid power source 202, i.e., a power source matching the voltage to be applied to the grid 102*c* is used. The controller 203 turns on or off the switches S1 and S2 such that the application of a voltage to the grid 102*c* starts earlier than the start of application of a voltage to the wires 102*a* and ends later than the end of application of the latter voltage, as shown in FIG. 3. This allows the voltage to the grid 102*c* and, therefore, the charge potential of the drum 101 to rise and fall rapidly. Further, the application of a bias voltage for development to the sleeve 115 is so controlled as to start and end the period of time Tb later than the start and end of the voltage to the wires 102*a*. This prevents the toner from depositing on the surface of the drum 101 other than an image area and prevents the drum 101 from being excessively charged or being burned by a leak.

In the illustrative embodiment, the charge potential $V_d$ (background), the potential $V_l$ of an exposed area (image area), and the bias voltage $V_b$ for the developing sleeve 115 are selected to be −800 V, −100 V, and −600 V, respectively. The latent image is developed by the difference between the potential $V_l$ and the potential $V_b$, i.e., $V_l - V_b = 500$ V.

The above-described advantages are attainable even with an arrangement wherein discharge wires and a grid share a single power source only if the voltages are applied at the timings shown in FIG. 3 via switches assigned to the wires and grid and a varistor associated with the grid.

Figure 4:
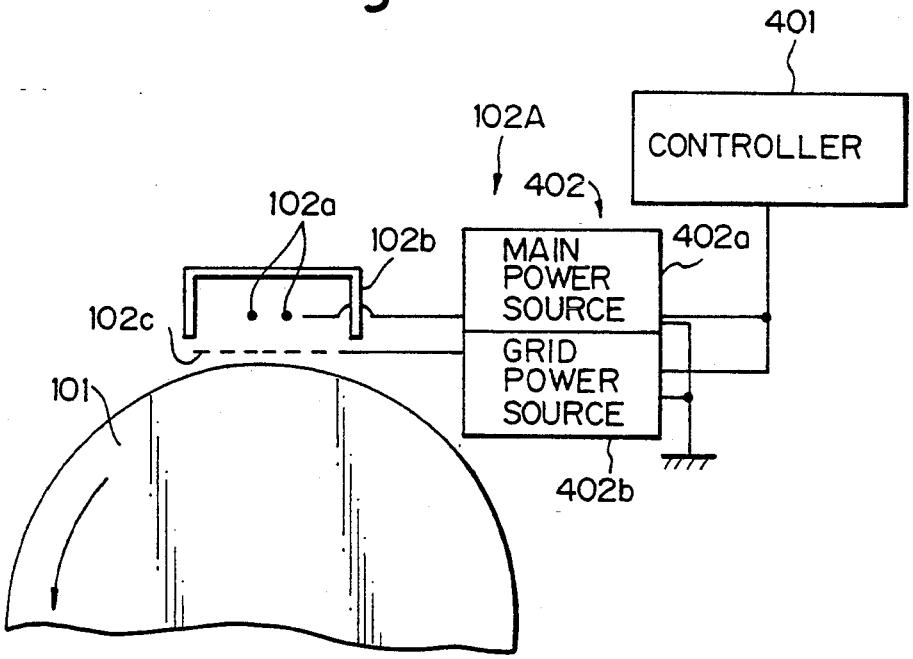
FIG. 4 shows an alternative embodiment of the present invention.

A reference will be made to FIG. 4 for describing an alternative embodiment of the present invention. In FIG. 4, the same parts and elements as those shown in FIG. 2 are designated by like reference numerals, and redundant description will be avoided for simplicity. As shown, the charging device 102A has a controller 401 for generating signals commanding the start and end of discharge, and a composite power source unit 402. The power source unit 402 has a main power source section 402*a* and a grid power source section 402*b* for applying voltages to the discharge wires 102*a* and the grid 102*c*, respectively, in response to the signal from the controller 401. As FIG. 4 indicates, the signals fed from the controller 401 to the main and grid power source sections 402*a* and 402*b* are identical. This implements the delivery of signals from the controller 401 to the power source unit 402 by a single line, thereby reducing noise ascribable to a harness. On receiving a signal commanding the start of voltage application from the controller 402*a*, the main power source section 402*a* starts applying a voltage while delaying it a predetermined period of time. On the other hand, the grid power source section 402*b* starts applying a voltage immediately in response to the signal. Conversely, on receiving a signal commanding the end of voltage application, the main power source section 402*a* ends the application immediately while the grid power source 402*b* ends it a predetermined period of time later.

Figure 5:
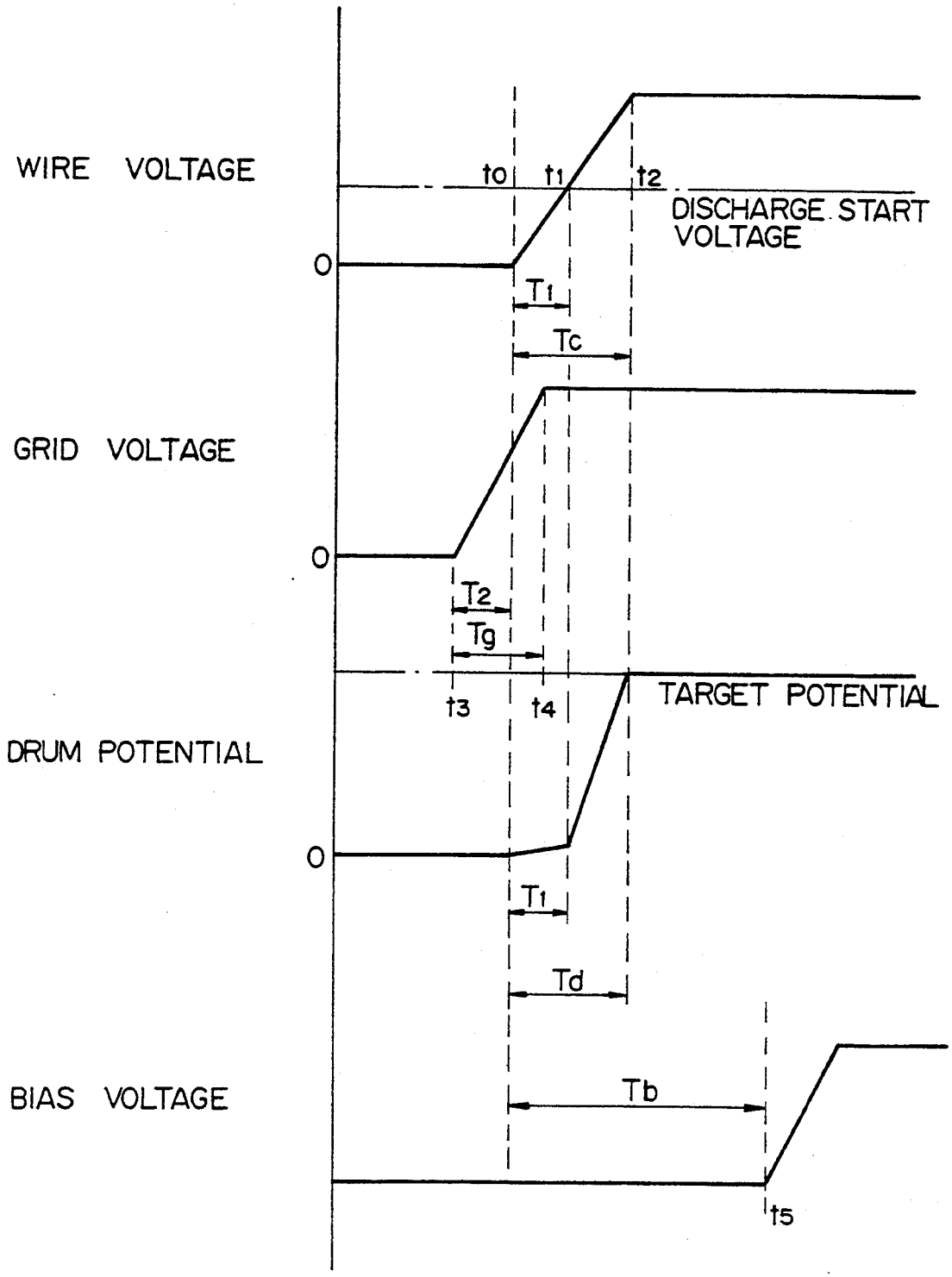
FIG. 5 is a timing chart demonstrating the operation of the embodiment shown in FIG. 4.
Figure 6:
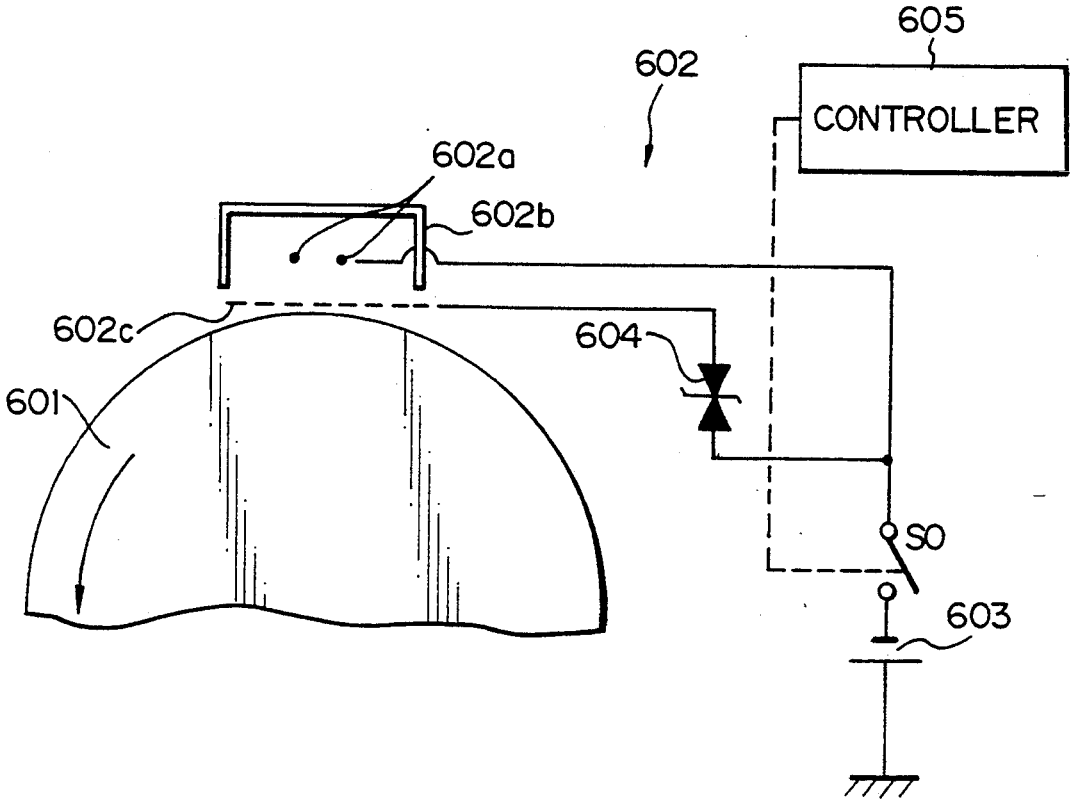
Fig. 6 PRIOR ART
FIG. 6 shows a conventional scorotron charger.
Figure 7A:
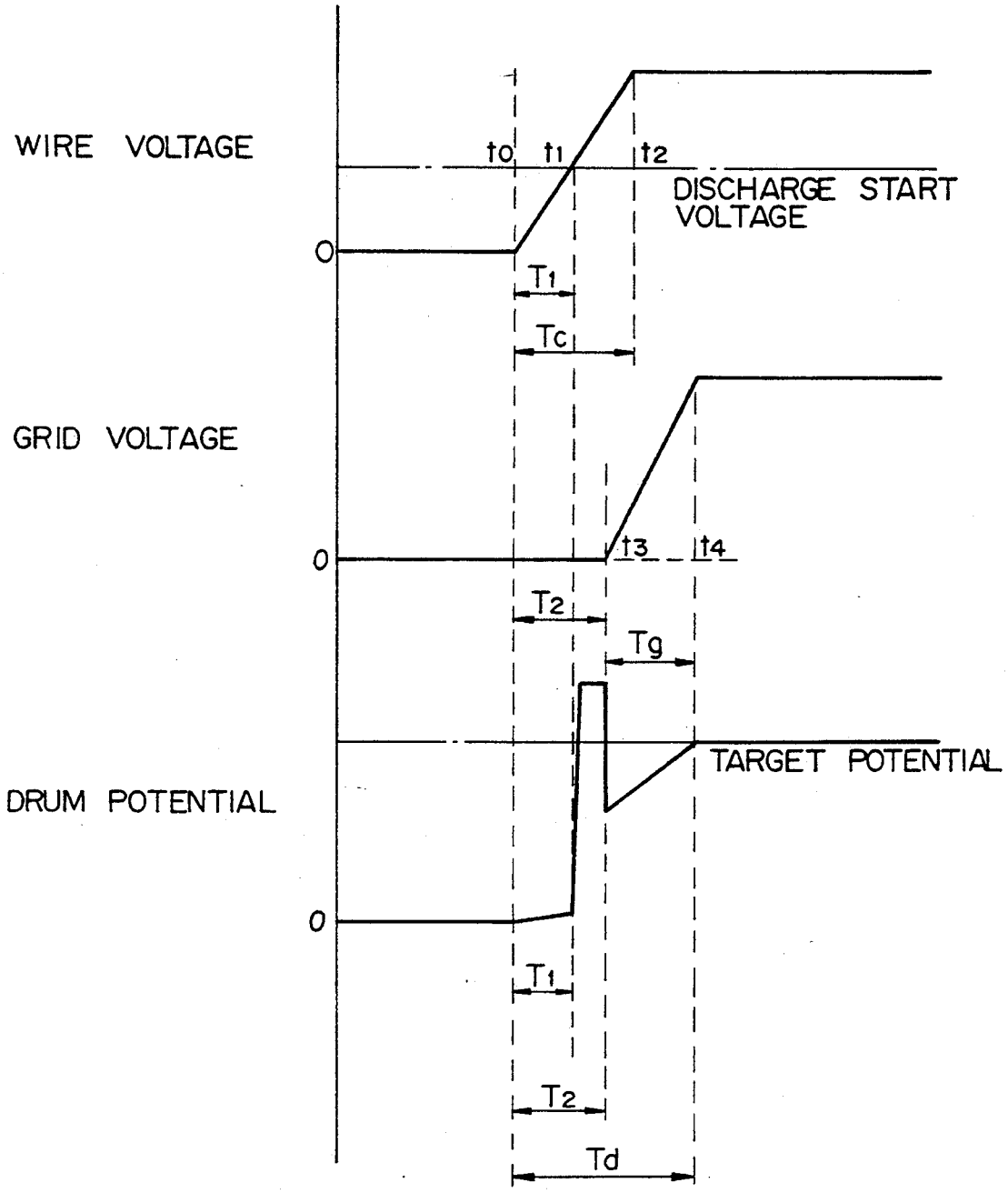
Fig. 7A PRIOR ART
FIG. 7 is a timing chart representative of the operation of the charging device shown in FIG. 6.
Figure 7B:
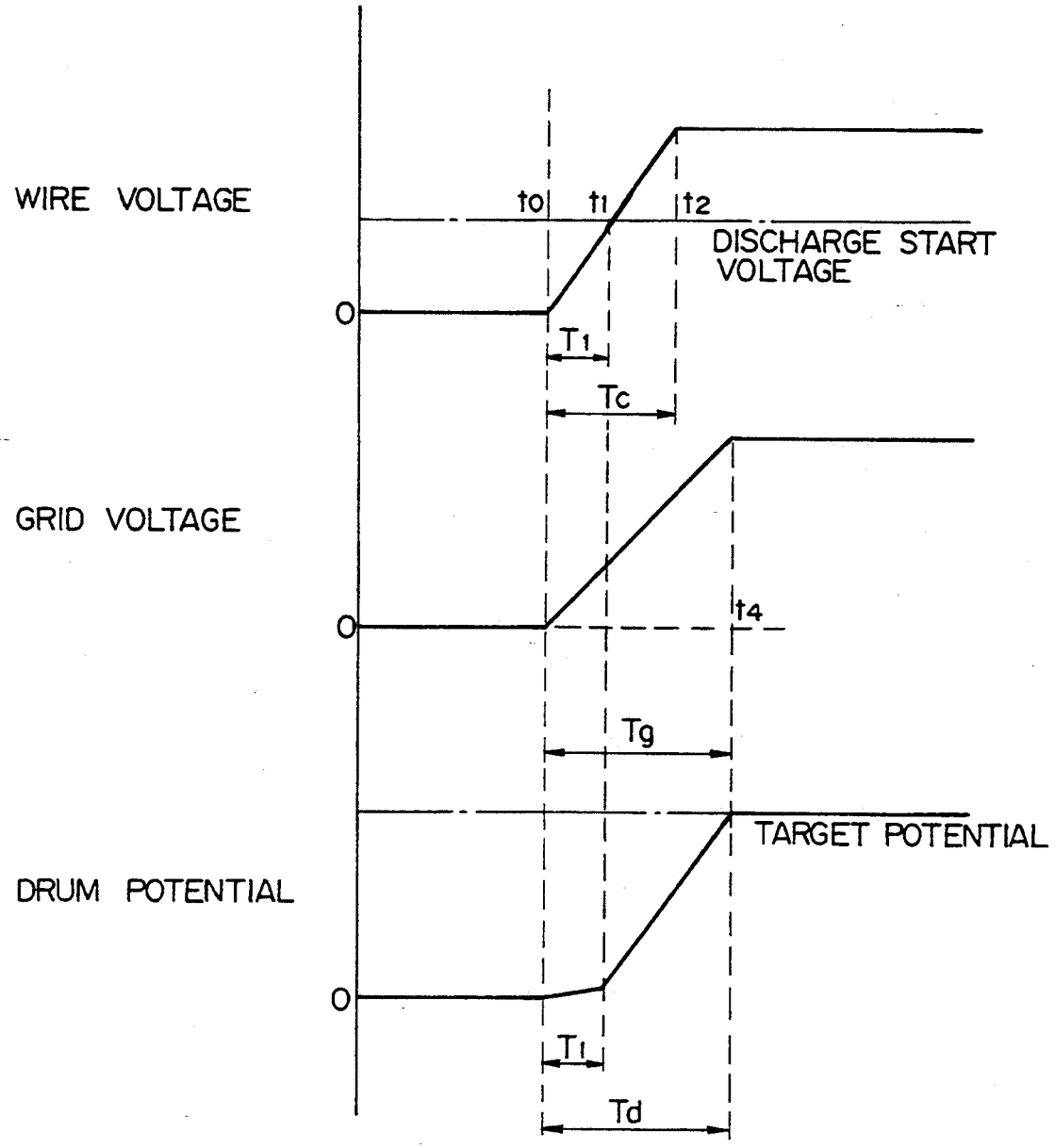
Fig. 7B PRIOR ART

FIG. 5 shows a relation of the voltage applied to the wires 102*a* by the charging device 102A, the voltage applied to the grid 102*c*, the bias voltage applied to the developing sleeve 115, and the potential of the drum 101 to one another. As FIG. 5 indicates, the grid voltage starts rising at a time $t_3$ which is a period of time $T_2$ earlier than the rise of the wire voltage and fully rises at a time $t_4$ before the wire voltage reaches a discharge start voltage thereof, i.e., $t_1$. Also, the charge potential of the drum 101 rises rapidly. The bias voltage for development rises at a time $t_5$, i.e., on the elapse of the period of time Tb after the time $t_0$. This is successful in achieving the same advantages as described in relation to the previous embodiment.

The grid power source section 402*b* will be described more specifically. When a voltage is not applied to the grid 102*c*, a current to flow from the wires 102*a* to the drum 101 cannot be adjusted since the impedance between the grid 102*c* and ground is high, as stated earlier. In this condition, it is likely that the drum 101 is charged excessively or a current leaks from the wires 102*a* to the drum 101. In light of this, the grid power source section 402*b* is provided with two switches, although not shown in the figures. One of the two switches is used to apply the voltage to the grid 102*c* (referred to as a switch A hereinafter), and the other is included in a circuit which shorts the circuiry between the grid 102*c* and ground (referred to as a switch B hereinafter). On receiving a signal commanding the start of application of a voltage to the grid 102*c* from the controller 401, the grid power source section 402*b* closes the switch A to apply a voltage to the grid 102*c* and then opens the switch B to cancel the shorting between the grid 102*c* and ground. The short interval between the closing of the switch A and the opening of the switch B is provided since the voltage may fail to rise immediately after the switch A has been closed. To end the application of the voltage, the power source section 402*b* closes the switch B and then opens the switch A. This surely frees the drum 101 from excessive charging and prevents a current from leaking from the wires 102*a* to the drum 101 while no voltages are applied to the grid 102*c*.

While the above embodiment uses the switches A and B, they may be replaced with a lower impedance between the grid 102*c* and ground or circuitry capable of cancelling the shorting between the grid 102*c* and ground automatically in response to a voltage to the grid 102*c*.

In summary, it will be seen that the present invention provides a charging device for image forming equipment which eliminates the excessive charging and burning of a photoconductive element ascribable to the time when a grid voltage starts rising or falling and the period of time necessary for it to fully rise or fully fall. In addition, the charging device of the invention causes the potential of the photoconductive element to rise and fall rapidly to prevent a toner or a carrier from depositing needlessly on the photoconductive element.

Various modifications will become possible for those skilled in the art after receiving the teachings of the present disclosure without departing from the scope thereof.

What is claimed is:

1. A scorotron charging device for electrophotographic image forming equipment, comprising:

a main charger for charging a photoconductive element;

a grid located in close proximity to said main charger;

a main charger power source for applying a voltage to said main charger;

a grid power source for applying a voltage to said grid; and control means for controlling a timing for said main charger power source to apply a voltage and a timing for said power source to apply a voltage, wherein said control means controls said charger power source and the grid power source such that said grid power source starts applying a voltage earlier than said main charger power source and the grid power source applies its full voltage prior to the main charger reaching a discharge start voltage, and said main charger stops applying the voltage earlier than said grid power source stops applying the voltage.

2. A device as claimed in claim 1, wherein said image forming equipment comprises a photoconductive element and a developing device applied with a bias voltage for developing a latent image which is electrostatically formed on said photoconductive element, said control means controlling said developing device, said main charger power source and said grid power source such that said bias voltage starts being applied later than the voltage applied by said main charger power source by a period of time necessary for the surface of said photoconductive element to move from said main charger to said developing device and ends being applied later than said voltage applied by said main charger power source by said period of time.

3. A scorotron charging device for electrophotographic image forming equipment, comprising:

a main charger for charging a photoconductive element;

a grid located in close proximity to said main charger;

control means for generating a trigger signal for commanding the start of application of voltages to said main charger and said grid;

main charger applying means for applying a voltage to said main charger at a predetermined timing in response to said trigger signal; and grid applying means for applying a voltage to said grid at a predetermined timing in response to said trigger signal;

wherein said control means controls said charger power source and the grid power source such that said grid power source starts applying a voltage earlier than said main charger power source and the grid power source applies its full voltage prior to the main charger reaching a discharge voltage, and said main charger stops applying the voltage earlier than said grid power source stops applying the voltage.

4. A device as claimed in claim 3, wherein said control means delivers the same trigger signal to said main charger applying means and said grid applying means.

* * * * *